US006114297A

United States Patent [19]

Yamaguchi et al.

[11] Patent Number: 6,114,297

[45] Date of Patent: Sep. 5, 2000

[54] DETERGENT COMPOSITION FOR CLOTHING

[75] Inventors: Shu Yamaguchi; Hitoshi Tanimoto; Masaki Tsumadori, all of Wakayama, Japan

[73] Assignee: Kao Corporation, Tokyo, Japan

[21] Appl. No.: 09/142,433

[22] PCT Filed: Mar. 10, 1997

[86] PCT No.: PCT/JP97/00750

§ 371 Date: Sep. 9, 1998

§ 102(e) Date: Sep. 9, 1998

[87] PCT Pub. No.: WO97/33969

PCT Pub. Date: Sep. 18, 1997

[30] Foreign Application Priority Data

Mar. 11, 1996 [JP] Japan ..... 8-83239

[51] Int. Cl.[7] ..... C11D 17/00

[52] U.S. Cl. ..... 510/351; 510/349; 510/352; 510/438

[58] Field of Search ..... 510/315, 349, 510/352, 443, 444, 475, 507, 351, 438

[56] References Cited

U.S. PATENT DOCUMENTS

| | | | |
|---|---|---|---|
| 5,482,642 | 1/1996 | Agar et al. | 252/90 |
| 5,540,855 | 7/1996 | Baillely et al. | 510/276 |
| 5,583,098 | 12/1996 | Boskamp et al. | 510/351 |

FOREIGN PATENT DOCUMENTS

| | | |
|---|---|---|
| 0219314A2 | 4/1987 | European Pat. Off. . |
| 0456315A2 | 11/1991 | European Pat. Off. . |
| 2-178398 | 7/1990 | Japan . |
| 7-11292 | 1/1995 | Japan . |
| 7-53992 | 2/1995 | Japan . |
| 7-173493 | 7/1995 | Japan . |
| 7-197084 | 8/1995 | Japan . |

*Primary Examiner*—Yogendra Gupta
*Assistant Examiner*—Gregory E. Webb
*Attorney, Agent, or Firm*—Birch, Stewart, Kolasch & Birch, LLP

[57] ABSTRACT

The detergent composition for clothes washing includes (I) surfactant components including:

A) one or more sulfonate-type anionic surfactants; and B) at least one of nonionic surfactants and sulfate-type anionic surfactants, wherein a weight ratio of Component B to Component A is B/A=1/10 to 2/1; and (II) components including:

C) one or more alkali metal silicates; and D) one or more metal ion capturing agents other than component C), wherein a weight ratio of Component C to Component D is C/D=1/15 to 5/1. Here, a total amount of the components (I) is from 20 to 50% by weight, and a total amount of the components (II) is from 30 to 80% by weight, and the detergent composition has a bulk density of 0.6 g/cc or more.

15 Claims, 1 Drawing Sheet

DETERGENT COMPOSITION FOR CLOTHING

This application is the national phase under 35 U.S.C. §371 of prior PCT International Application No. PCT/JP97/00750 which has an International filing date of Mar. 10, 1997 which designated the United States of America, the entire contents of which are hereby incorporated by reference.

TECHNICAL FIELD

The present invention relates to a detergent composition for clothes washing, and a process for washing clothes using the detergent composition. More specifically, the present invention relates to a detergent composition for clothes washing exhibiting excellent detergency with a small amount of dosage, and a process for washing clothes using the detergent composition.

BACKGROUND ART

Moreover, to date, various kinds of chelating agents, ion exchange materials, alkalizing agents, and dispersants have been known to be used for builders to be blended in detergents. Particularly, the phosphoric acid-based chelating agents such as tripolyphosphates as a main component thereof have good water solubility and detergency, so that they have been formulated as main detergent builder components.

In recent years, however, the use of tripolyphosphates has been decreased, since they can cause eutrophication in closed water areas such as lakes and marshes. Instead, crystalline aluminosilicates (zeolites) have been commonly used as substitutes for the metal ion capturing agent, as typically disclosed in Japanese Patent Laid-Open No. 50-12381, of which the disclosure is incorporated herein by reference. Such detergents formulating zeolites as mentioned above would require a standard amount of dosage of 40 g per one washing cycle, the washing cycle being most commonly using about 30 L of the washing liquid per one cycle in Japan. Also, the powder detergents available at that time had a low bulk density at a level of 0.20 to 0.45 g/ml owing to the solubility in cold water. As a result, the standard volumetric amount is made as high as about 90 to about 200 ml of detergents per 30 L of water for washing, so that much inconveniences were caused in handling during distribution, and in shops and households.

Therefore, an intense investigation has been made to produce compact detergents. For instance, Japanese Patent Laid-Open Nos. 62-167396, 62-167399, and 62-253699, of which the disclosure is incorporated herein by reference, disclose a remarkable decrease in the amount of crystalline inorganic salts such as sodium sulfate used as powdering aids conventionally contained in detergents. In addition, Japanese Patent Laid-Open Nos. 61-69897, 61-69899, 61-69900, and 5-209200, of which the disclosure is incorporated herein by reference, disclose that an increase in the bulk density of the detergents. By these findings, detergents having a bulk density of from 0.60 to 1.00 g/ml, whose standard amount of dosage is from 25 to 30 g/30 L, can be produced, thereby resulting in making the detergents compact to a level of a standard volumetric amount of from 25 to 50 ml/30 L.

However, in conventional detergents, a large amount of surfactants had to be blended in the detergent compositions because mainstream of the technical idea was to make the oily components in dirt soluble by surfactants. Specifically, sebum dirt stains ascribed to human bodies, the most typical dirt stains adhered to clothes (most likely to be observed on collars and sleeves), are taken as examples. The sebum dirt stains contain oily components, such as free fatty acids and glycerides, with a high content of 70% or more (Ichiro KASHIWA et al., "Yukagaku," 19, 1095 (1969), of which the content is incorporated herein by reference). The oily components lock carbon and dirt in dust and peeled keratin, so that the resulting substance is observed as dirt stain composites. In order to wash off the sebum dirt stains, conventionally detergents are designed based on a washing mechanism mainly by making these oily components soluble with micelle of surfactants, thereby detaching carbon, dirt, and keratin from clothes. This technical idea has been widely established among those of ordinary skill in the art, and even when the conventional detergents are shifted to compact detergents, substantially no changes took place in the surfactant concentration in the washing liquid. This fact is described in "Dictionary for Detergents and Washing," Haruhiko OKUYAMA et al., p. 428, 1990, First Edition, Asakura Publishing Company Limited, of which the content is incorporated herein by reference. It can be inferred that there are substantially no changes in concentrations in the washing liquid for components other than sodium sulfate.

Based on these washing principles, the surfactant concentration in the washing liquid has to be made high in order to achieve high washing power, so that a large amount of surfactants has to be blended in the detergent composition. In other words, in a case where the standard amount of dosage is simply reduced in the conventional detergent compositions, the absolute amount of the surfactants in the washing liquid is evidently reduced. Therefore, in a system where the detergency is dependent upon the micelle-formation ability of the surfactants, which is based on a conventional technical idea, a relative surfactant concentration in the compositions has to be increased even when the standard amount of dosage is reduced, so that the balance in the detergent composition between the surfactant to be needed and other components is lost. Therefore, a further reduction in the standard volumetric amount was deemed to be technically extremely difficult problem.

On the other hand, crystalline alkali metal silicates having particular structure disclosed in Japanese Patent Laid-Open Nos. 5-184946 and 60-227895, of which the disclosure is incorporated herein by reference, shows not only good ion exchange capacity but also actions of alkalizing agents (alkalizing ability). Therefore, possibility of more compact detergents has been studied because both of the functions which conventionally have been satisfied by two different components, including metal ion capturing agents, such as zeolites, and alkalizing agents, such as sodium carbonate, can be satisfied with the above crystalline alkali metal silicates alone.

For instance, Japanese Patent Laid-Open No. 6-116588, of which the disclosure is incorporated herein by reference, is concerned with a detergent composition containing a crystalline alkali metal silicate. In Examples of this publication disclosing a more compact detergent, even in a case where the amount of the detergent composition at washing is reduced by 25% by weight, the detergent composition has a washing power substantially the same as conventional detergent compositions. However, the composition is formulated based on the conventional washing principle, and the composition is obtained by simple replacement of the alkalizing agent and the ion exchange material with the crystalline alkali metal silicate. Therefore, the ion exchange capacity are ascribed solely to the crystalline alkali metal silicates contained therein, so that the ion exchange capacity is deficient for that needed for detergent compositions. In this case, the functions of the crystalline alkali metal silicates as alkalizing agents are prioritized over their functions as metal ion capturing agents, so that the washing power of the detergent composition is not always satisfactory, owing to the fact that the washing power of the detergent composition is likely to be affected by the water hardness of water for washing. Therefore, if the amount of dosage of the detergent composition were reduced, a good washing power is not able to be maintained.

A number of patent applications have been filed concerning the crystalline silicates disclosed in Japanese Patent Laid-Open No. 60-227895, of which the disclosure is incorporated herein by reference. Japanese Patent Unexamined Publication No. 6-502199, of which the disclosure is incorporated herein by reference, discloses a detergent comprising a layered crystalline silicate, a zeolite, and a polycarboxylate in particular proportions, to thereby provide a detergent which is free from providing film layer formation on fibers and has excellent washing power and bleaching agent stability. However, under the blending conditions given in this publication, when the amount of the detergents added was reduced at washing, the alkalizing ability is deficient because the amount of the crystalline alkali metal silicate in the builder composition is small, thereby making it impossible to maintain good washing power. Also, this publication never teaches the technical idea that an excellent washing power is exhibited in a small amount of dosage of detergents.

The same can be said for detergents containing crystalline alkali metal silicates disclosed in Japanese Patent Unexamined Publication 6-500141, Japanese Patent Laid-Open Nos 2-178398 and 2-178399, each of which the disclosure is incorporated herein by reference. None of the references do not pertain to detergents used in a small amount of dosage as taught in the present invention. Rather, in the case where the amounts of the detergent compositions shown in each of Examples are reduced, the washing power is lowered.

Japanese Patent Laid-Open No. 7-53992, of which the disclosure is incorporated herein by reference, discloses that the amount of dosage per cycle is reduced by formulating the layered crystalline silicate disclosed in Japanese Patent Laid-Open No. 60-227895, together with other builder components such as alkalizing agents and metal ion capturing agents, wherein the layered crystalline silicate is added in excess to the builder components. The technical idea disclosed herein is a conventional idea simply rephrasing that the alkalizing agents and the metal ion capturing agents added as two components are substituted with a single component of the crystalline alkali metal silicate, and thereby the resulting compositions have detergency notably impaired by the changes in the water hardness of tap water. Therefore, it would be difficult to attain sufficient detergency with a standard amount of dosage of 20 g or less per 30 L of water for washing under the water hardness conditions in Japan. And as the water hardness increases, the detergency is likely to become lower than that of conventional detergents.

Accordingly, an object of the present invention is to provide a detergent composition for clothes washing exhibiting excellent detergency even at a low surfactant concentration.

Another object of the present invention is to provide a process for washing clothes using the above detergent composition.

These and other objects of the present invention will be apparent from the following description.

DISCLOSURE OF THE INVENTION

As a result of intense research in view of the above objects, the present inventors have found in an extremely simple washing system the relationship between the conditions for washing clothes and the detergency, and have developed a detergent composition showing excellent detergency with a small standard amount of dosage by analyzing the reason for excellent detergency in a particular high alkali, low water hardness washing conditions.

Specifically, while studying the washing liquid capable of showing good detergency, the present inventors have found that the higher the pH and the lower the water hardness, the lower the dependency of the detergency on the surfactant concentration, so that good detergency can be achieved. Also, in the case of a high pH but a high water hardness, the detergency is drastically lowered even at a high pH. In the case of washing solely with a composition containing a surfactant without containing any alkalizing agents, although the detergency at low water hardness is low, the dependency of the detergency on the water hardness is sufficient small when compared to systems containing alkalizing agents. From these results, the present inventors have paid attention to the relationship between the washing liquid and the dirt stains.

As discussed in the Background Art section of the present invention, the sebum dirt stains which are the most typical dirt stains adhered to clothes contain fatty acids and glycerides, and the dirt stains are presumably a mixture of these organic materials with carbon, dirt, or peeled keratin. In the case of a high pH, while the content of the fatty acids increases by hydrolysis of glycerides, the reaction of the fatty acids with alkali metals to form salts also proceeds. The alkali metal salts of the fatty acids are soaps, so that the freeing speed of the dirt stains in the washing liquid becomes notably faster. However, this reaction is a competitive reaction with calcium ions, magnesium ions, etc. in the hard water. Since the alkali metal salts of fatty acids form a scum by carrying out ion-exchange reaction with calcium and magnesium, the dirt stains are solidified without being freed from the interface of clothes in the case where the water hardness is high. For the reasons given above, in the case where the pH is high and the water hardness is low, the washing liquids show excellent detergency, and in the case where the pH is high and the water hardness is high, the washing liquids show notably lowered detergency. Also, in the case where an alkalizing agent is not formulated, the dependency of the detergency on the water hardness become comparatively lower than the systems containing alkalizing agents, owing to the fact that the sebum dirt stains are washed only with washing power ascribed to the surfactants.

From these observations, the present inventors have found that one of the reasons for obtaining a detergency at a level equivalent or higher than that obtainable in the conventional detergents even while having a notably lower surfactant concentration in the washing liquid than the conventional detergents is the fact that the soaps formed by the saponification of the glycerides in the dirt stains under the conditions of a low water hardness and a high pH significantly act to give good detergency. Therefore, they have found a detergent composition for clothes washing with a smaller standard amount of dosage than conventional detergents where the detergency is solely dependent on surfactants. The present invention has been completed based upon these findings.

Specifically, the present invention is concerned with the following:

(1) A detergent composition for clothes washing comprising:

(I) surfactant components comprising:

A) one or more sulfonate-type anionic surfactants; and

B) at least one of nonionic surfactants and sulfate-type anionic surfactants, wherein a weight ratio of Component B to Component A is B/A=1/10 to 2/1; and (II) components comprising:

C) one or more alkali metal silicates; and

D) one or more metal ion capturing agents other than component C), wherein a weight ratio of Component C to Component D is C/D=1/15 to 5/1, wherein a total amount of the components (I) is from 20 to 50% by weight, and a total amount of the components (II) is from 30 to 80% by weight, and wherein the detergent composition has a bulk density of 0.6 g/cc or more;

(2) The detergent composition for clothes washing described in item (1) above, wherein the sulfonate-type anionic surfactants are one or more compounds selected from the group consisting of linear alkylbenzenesulfonates, of which alkyl moiety has an average number of carbon atoms of 12 to 18; α-sulfofatty acid salts or methyl ester salts thereof, each of which alkyl moiety has an average number of carbon atoms of 14 to 18; and α-olefinsulfonates of which alkyl moiety has an average number of carbon atoms of 12 to 18;

(3) The detergent composition for clothes washing described in item (1) or (2) above, wherein the nonionic surfactants are one or more polyoxyalkylene alkyl ethers;

(4) The detergent composition for clothes washing described in item (3) above, wherein the polyoxyalkylene alkyl ethers are alkylene oxide adducts of alcohols, obtained by adding an alkylene oxide in an average amount of 4 to 10 moles of alcohols, of which alkyl moiety has an average number of carbon atoms of 10 to 18;

(5) The detergent composition for clothes washing described in any one of items (1) to (4) above, wherein the sulfate-type anionic surfactants are one or more compounds selected from the group consisting of alkylsulfates or alkenylsulfates, of which alkyl or alkenyl moiety has an average number of carbon atoms of 12 to 22, and alkyl ether sulfates, of which ethylene oxide moiety has an average addition molar number of 1 to 4;

(6) The detergent composition for clothes washing described in any one of items (1) to (5) above, wherein the alkali metal silicate is a crystalline alkali metal silicate.

(7) The detergent composition for clothes washing described in item (6) above, wherein the crystalline alkali metal silicate is contained in an amount of from 50 to 100% by weight of the entire amount of alkalizing agents in the detergent composition;

(8) The detergent composition for clothes washing described in item (6) above, wherein the crystalline alkali metal silicate has an $SiO_2/M_2O$ molar ratio of from 0.5 to 2.6, wherein M stands for an alkali metal;

(9) The detergent composition described in item (8) above, wherein the crystalline alkali metal silicate is represented by the following formula (1):

$$xM_2O.ySiO_2.zMe_mO_n.wH_2O, \quad (1)$$

wherein M stands for an element in Group Ia of the Periodic Table; Me stands for one or more elements selected from the group consisting of Group IIa, IIb, IIIa, IVa, and VIII; y/x is 0.5 to 2.6; z/x is 0.01 to 1.0; n/m is 0.5 to 2.0; and w is 0 to 20;

(10) The detergent composition described in item (8) above, wherein the crystalline alkali metal silicate is represented by the following formula (2):

$$M_2O.x'SiO_2.y'H_2O, \quad (2)$$

wherein M stands for an alkali metal atom; x' is 1.5 to 2.6; and y' is 0 to 20;

(11) The detergent composition described in any one of items (1) to (10) above, wherein the D) metal ion capturing agents comprise:

(D-i) a carboxylate polymer having a Ca ion capturing capacity of 200 $CaCO_3$ mg/g or more; and (D-ii) an aluminosilicate having an ion exchange capacity of 200 $CaCO_3$ mg/g or more and having the following formula (3):

$$x''(M_2O).Al_2O_3.y''(SiO_2).w''(H_2O), \quad (3)$$

wherein M stands for an alkali metal atom; x", y", and w" each stands for a molar number of each component; x" is from 0.7 to 1.5; y" is from 0.8 to 6; and w" is from 0 to 20, and wherein a weight ratio of (D-i) component to (D-ii) component is (D-i)/(D-ii)=1/20 to 4/1, and a total amount of (D-i) and (D-ii) components occupies 70 to 100% by weight of the D) metal ion capturing agent;

(12) In a process for washing clothes utilizing a detergent composition, the improvement for which comprises using a composition as described in any one of items (1) to (11) as a detergent composition;

(13) The process described in item (12) above, wherein the detergent composition is used at a concentration of from 0.33 to 0.67 g/L in the washing liquid with a water hardness of from 2 to 6°DH;

(14) The process described in item (12) above, wherein the detergent composition is used at a concentration of from 0.50 to 1.20 g/L in the washing liquid with a water hardness of from 6 to 10°DH;

(15) The process described in item (12) above, wherein the detergent composition is used at a concentration of from 0.80 to 2.50 g/L in the washing liquid with a water hardness of from 10 to 20°DH;

(16) Use of a composition as described in any one of items (1) to (11) as a detergent composition for washing clothes;

(17) Use of a composition described in item (16) above, wherein the detergent composition is used at a concentration of from 0.33 to 0.67 g/L in the washing liquid with a water hardness of from 2 to 6°DH;

(18) Use of a composition described in item (16) above, wherein the detergent composition is used at a concentration of from 0.50 to 1.20 g/L in the washing liquid with a water hardness of from 6 to 10°DH; and

(19) Use of a composition described in item (16) above, wherein the detergent composition is used at a concentration of from 0.80 to 2.50 g/L in the washing liquid with a water hardness of from 10 to 20°DH.

Figure 2:
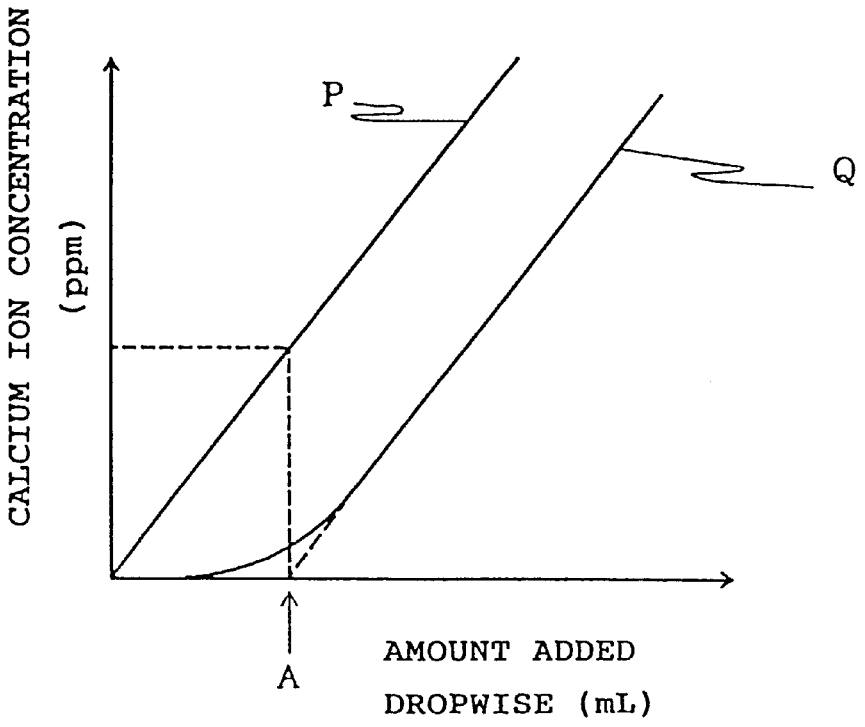
FIG. 2 is a graph showing the relationships between the amount of the $CaCl_2$ aqueous solution added dropwise and the calcium ion concentration.

The reference numerals in FIG. 2 are as follows:

A is an intersection of the extension of the linear portion of Line Q with the abscissa (horizontal axis); P shows the data of the blank solution (buffer solution without using the chelating agent); and Q shows the data for the chelating agent-containing buffer solution.

BEST MODE FOR CARRYING OUT THE INVENTION

In order to achieve an excellent washing power, a washing liquid having a high pH and low water hardness needs to be produced. In order to meet the above requirements, the washing liquid has to satisfy the following conditions.

(i) Containing excess metal ion capturing agents.

(ii) Containing an alkalizing agent acting as a buffer at a high pH.

From the aspect of having a high pH, the alkali metal silicates are preferred. Here, sodium silicates such as JIS No. 1 and JIS No. 2 usually used in detergents do not show metal ion capturing ability, while the crystalline alkali metal silicates are more preferred from the aspect of simultaneously satisfying both conditions (i) and (ii). However, some precautions are needed even when the crystalline alkali metal silicate is used, because the alkalizing ability increases when the amount of the crystalline alkali metal silicate increases owing to its low water hardness. In such a case, it may inevitably result in an undesirable increase in the binding speeds of Ca and Mg to the fatty acids. Therefore, in order to more satisfactorily meet the above conditions, it is preferred that other metal ion capturing agents may be formulated in a particular proportion, within which range the standard amount of dosage of the detergents can be effectively reduced. In Japanese Patent Laid-Open No. 7-53992 mentioned in the BACKGROUND ART section of the present invention disclosing a technique using a crystalline alkali metal silicate, the reasons for the lowered detergency by an increase in the water hardness of tap water are also the same as described above. In other words, in the case where the metal ion capturing ability is relied solely in the crystalline alkali metal silicate in a conventional composition, the alkalizing ability is high when compared to the chelating ability, so that the scum formation ascribed to the dirt stains is inevitably likely to take place as the water hardness increases, which in turn results in a lowered detergency.

Therefore, in order to obtain an effective washing power against compound dirt stains, the following surfactant components and builder components are blended in the detergent composition.

The surfactant components (I) comprise:

A) one or more sulfonate-type anionic surfactants; and

B) at least one of nonionic surfactants and sulfate-type anionic surfactants, wherein a total amount of the surfactant components comprise 20 to 50% by weight, preferably 30 to 40% by weight of the entire detergent composition. Also, the weight ratio of Component B to Component A is B/A=1/10 to 2/1, preferably 1/5 to 1/1, within which range high detergency of the resulting detergent composition can be obtained with a small amount of dosage.

The builder components (II) comprise:

C) one or more crystalline alkali metal silicates; and

D) one or more metal ion capturing agents other than component C), wherein a total amount of the builder components comprise 30 to 80% by weight, preferably 30 to 50% by weight, of the entire detergent composition. Also, the weight ratio of Component C to Component D is C/D=1/15 to 5/1. The total amount of the builder components is preferably 30% by weight or more from the aspect of aggressively accelerating the self-emulsification effects of the sebum dirt stains. The total amount is preferably 80% by weight or less, from the viewpoint of maintaining good compositional balance, and thus having high detergency. The weight ratio is preferably within the above-given range, from the aspect of aggressively accelerating the self-emulsification effects of the sebum dirt stains.

The preferred weight ratio of Component C to Component D is C/D=1/15 to 3/1, and the highly preferred weight ratio differs depending upon the initial water hardness of washing liquids used. In the case where the water hardness is from 2 to 6°DH, the C/D weight ratio is highly preferably from 3/7 to 3/1; in the case where the water hardness is from 6 to 10°DH, the C/D weight ratio is highly preferably from 1/6 to 4/3; and in the case where the water hardness is from 10 to 20°DH, the C/D weight ratio is highly preferably from 1/15 to 1/1.

The detergent composition for clothes washing of the present invention has a bulk density of 0.6 g/cc or more, preferably from 0.7 to 1.1 g/cc. By obtaining the resulting detergent composition subjected to volume concentration as well as weight concentration, commercial values of the detergent products are increased in various circumstances, including easy use for consumers and saved spaces for distribution and shopping areas.

The tap water has water hardness greatly differing in various countries and geographical circumstances throughout the world. For instance, while the tap water has a water hardness of usually around 4°DH in Japan, the tap water having a water hardness of 6°DH or more in the U.S., and that exceeding 10°DH in European countries is used for the water for washing. Therefore, since the required absolute amount of the metal ion capturing agents varies, the standard detergent concentration would be optimally adjusted accordingly.

Specifically, in cases where the initial water hardness differs in each of the washing liquids, the detergent concentrations of the washing liquids are as follows:

1) As for the water for washing having a water hardness of 2 to 6°DH, the detergent composition has a concentration in the washing liquid of from preferably 0.33 to 0.67 g/L, more preferably from 0.33 to 0.50 g/L.

2) As for the water for washing having a water hardness of 6 to 10°DH, the detergent composition has a concentration in the washing liquid of from preferably 0.50 to 1.20 g/L, more preferably from 0.50 to 1.00 g/L.

3) As for the water for washing having a water hardness of 10 to 20°DH, the detergent composition has a concentration in the washing liquid of from preferably 0.80 to 2.50 g/L, more preferably from 1.00 to 2.00 g/L.

Under these conditions, detergency equivalent or superior to that of the conventional detergents can be achieved in the detergent composition for clothes washing of the present invention. Also, the DH water hardness is measured by an ion coupling plasma method (ICP method).

Each of the components will be explained in detail below.

A) Sulfonate-Type Anionic Surfactant

The sulfonate-type anionic surfactants usable in the present invention are not particularly limited, and any of conventional known ones may be used. The sulfonate-type anionic surfactants may be used singly, or in a mixture of two or more kinds. Examples of the sulfonate-type anionic surfactants include linear alkylbenzenesulfonates, of which alkyl moiety has an average number of carbon atoms of 12 to 18; α-sulfofatty acid salts or methyl ester salts thereof, each of which alkyl moiety has an average number of carbon atoms of 14 to 18; and α-olefinsulfonates of which alkyl moiety has an average number of carbon atoms of 12 to 18. The alkali metal ions are most suitably used as counter ions from the aspect of detergency.

B) Nonionic Surfactant and Sulfate-Type Anionic Surfactant

The nonionic surfactants are not particularly limited, and any of conventionally known ones may be used. Examples thereof include the following.

Polyoxyalkylene alkyl ethers, such as polyoxyethylene alkyl ethers and polyoxypropylene alkyl ethers, polyoxyethylene alkylphenyl ethers, polyoxyethylene sorbitan fatty acid esters, polyoxyethylene sorbitol fatty acid esters, polyoxyethylene fatty acid esters, polyoxyethylene fatty acid alkyl esters, polyoxyethylene polyoxypropylene alkyl ethers, polyoxyethylene castor oils, polyoxyethylene alkylamines, glycerol fatty acid esters, higher fatty acid alkanolamides, alkylglycosides, alkylglucosamides, and alkylamine oxides.

Among these nonionic surfactants, a preference is given to polyoxyalkylene alkyl ethers, and greater preference is given to alkylene oxide adducts of alcohols, of which alkyl moiety has an average number of carbon atoms of 10 to 18. The alcohols used herein may be preferably primary or secondary alcohols, of which alkyl moiety may be linear or branched. Examples of the alkylene oxides include ethylene oxide and propylene oxide. The alkylene oxides may be added in average, preferably from 4 to 10 moles, more preferably from 4 to 6.5 moles, particularly from 4 to 6 moles.

The propylene oxide adducts may be preferably those added with 1 to 4 moles of propylene oxide to an adduct in which ethylene oxide is previously added in an average of 1 to 10 moles. The ethylene oxide adducts may include polyoxyethylene alkyl ethers of which ethylene oxide moiety has an average additional molar number of 6 or less. More preferably, polyoxyethylene alkyl ethers which are ethylene oxide adducts of linear or branched, primary or secondary alcohols, of which alkyl moiety has 12 to 14 carbon atoms and ethylene oxide is added, in average, 2 to 5 moles.

The sulfate-type anionic surfactants are not particularly limited, and any of conventionally known ones may be used. The sulfate-type anionic surfactants may be used singly, or as a mixture of two or more kinds. Preferred examples thereof include the following: Alkylsulfates or alkenylsulfates, of which alkyl or alkenyl moiety has an average number of carbon atoms of 12 to 22, and alkyl ether sulfates, of which ethylene oxide moiety has an average additional molar number of 1 to 4. The alkali metal ions are preferably used as counter ions from the aspect of detergency, and a small amounts of alkaline earth metals may be also used.

C) Alkali Metal Silicate

The alkali metal silicates include crystalline and amorphous alkali metal silicates. In the present invention, the crystalline alkali metal silicates are particularly preferred owing to its good metal ion capturing ability as well as its good alkalizing ability by crystallization, so that the standard amount of dosage of the detergent composition can be even further reduced.

The crystalline alkali metal silicates will be explained hereinbelow as a preferred embodiment.

The crystalline alkali metal silicates preferably have $SiO_2/M_2O$ molar ratios of from 0.5 to 2.6, wherein M stands for an alkali metal atom. Also, the preferred ranges of the $SiO_2/M_2O$ molar ratios are 1.5 to 2.2. The above molar ratio is preferably 0.5 or more from the aspect of obtaining good ion exchange capacity and hygroscopic property, and the molar ratio is preferably 2.6 or less from the aspect of obtaining good alkalizing ability. Incidentally, the crystalline alkali metal silicates used in patent publications discussed in BACKGROUND ART section of the present invention have $SiO_2/Na_2O$ molar ratios (S/N ratio) of from 1.9 to 4.0. However, in the present invention, when the S/N ratios of the crystalline alkali metal silicates are 2.6 or less, the resulting detergents have good washing power with a remarkable reduction in the standard amount of dosage.

Among the crystalline alkali metal silicates usable in the present invention, a preference is given to those having the following compositions:

$$(1)\ xM_2O.ySiO_2.zMe_mO_n.wH_2O, \quad (1)$$

wherein M stands for an element in Group Ia of the Periodic Table; Me stands for one or more members selected from the group consisting of elements in Groups IIa, IIb, IIIa, IVa, and VIII of the Periodic Table; y/x is from 0.5 to 2.6; z/x is from 0.01 to 1.0; n/m is from 0.5 to 2.0; and w is from 0 to 20.

$$(2)\ M_2O.x'SiO_2.y'H_2O, \quad (2)$$

wherein M stands for an alkali metal atom; x' is from 1.5 to 2.6; and y' is from 0 to 20.

First, the crystalline alkali metal silicates having the composition (1) above will be detailed below.

In the general formula (1), M stands for an element selected from elements in Group Ia of the Periodic Table, wherein the Group Ia elements may be exemplified by Na, K, etc. These elements may be used alone, or in combination of two or more kinds. For instance, such compounds as $Na_2O$ and $K_2O$ may be mixed to constitute an $M_2O$ component.

Me stands for one or more members selected from the group consisting of elements in Group IIa, IIb, IIIa, IVa, and VIII of the Periodic Table, and examples thereof include Mg, Ca, Zn, Y, Ti, Zr, and Fe, which are not particularly limited to the above examples. Here, a preference is given to Mg and Ca from the viewpoint of resource stock and safety. In addition, these elements may be used alone, or in combination of two or more kinds. For instance, such compounds as MgO and CaO may be mixed to constitute an $Me_mO_n$ component.

In addition, the crystalline alkali metal silicates in the present invention may be in the form of hydrates, wherein the amount of hydration (w) is preferably in the range of from 0 to 20.

With respect to the general formula (1), y/x is preferably from 0.5 to 2.6, more preferably from 1.5 to 2.2. From the aspect of anti-solubility in water, y/x is preferably 0.5 or more. When the anti-solubility in water is insufficient, powder properties of the detergent composition, such as caking properties, solubility, etc. are drastically lowered. From the aspect of sufficiently functioning as alkalizing agent and ion exchange materials, y/x is preferably 2.6 or less.

With respect to z/x, it is from 0.01 to 1.0, preferably from 0.02 to 0.9, particularly from 0.02 to 0.5. From the aspect of the anti-solubility in water, z/x is preferably 0.01 or more, and from the aspect of sufficiently functioning as ion exchange materials, z/x is preferably 1.0 or less.

With respect to x, y and z, there are no limitations, as long as y/x and z/x have the above relationships. When $xM_2O$, for example, is $x'Na_2O.x''K_2O$ as described above, x equals to x'+x". The same can be said for z when $zMe_mO_n$ comprises two or more components. Further, "n/m is from 0.5 to 2.0"

indicates the number of oxygen ions coordinated to the above elements, which actually takes values selected from 0.5, 1.0, 1.5, and 2.0.

The crystalline alkali metal silicate in the present invention has an excellent alkalizing ability, to a level wherein its maximum pH value is 11.0 or more at 25° C. in a 0.1% by weight dispersion. From these features, the alkali metal silicates in the present invention are easily distinguishable from the aluminosilicates, such as zeolites. In addition, the crystalline alkali metal silicate particularly has an excellent alkaline buffering effects, showing remarkably superior alkaline buffering effects when compared to those of sodium carbonate and potassium carbonate.

The crystalline alkali metal silicate in the present invention preferably has an ion exchange capacity of 100 $CaCO_3$ mg/g or more, more preferably from 200 to 600 $CaCO_3$ mg/g. Therefore, the crystalline alkali metal silicate is one of the materials having ion capturing ability in the present invention.

The amount of Si dissolved in water is preferably 110 mg/g or less, when calculated as $SiO_2$, indicating that the crystalline alkali metal silicate is substantially insoluble in water. Here, the term "substantially insoluble in water" refers to those having an amount of Si dissolved, when calculated as $SiO_2$, of less than 110 mg/g, measurement being taken when adding a 2 g sample 100 g of ion-exchanged water and stirring the mixture at 25° C. for 30 minutes. In the present invention, the crystalline alkali metal silicate having an amount of Si dissolved in water of 100 mg/g or less are more preferred.

Since the crystalline alkali metal silicate in the present invention has not only good alkalizing ability and alkaline buffering effects but also good ion exchange capacity, the washing conditions may be suitably adjusted by adding suitable amounts of the crystalline alkali metal silicate.

In the present invention, the crystalline alkali metal silicate has an average particle size of preferably from 0.1 to 100 μm, more preferably from 1 to 50 μm, still more preferably from 5 to 30 μm. From the aspect of preventing the lowering of the ion exchange speed, the average particle size of the crystalline alkali metal silicate is preferably 100 μm or less. In addition, from the viewpoint of having an even smaller specific surface area, the average particle size is preferably 0.1 μm or more. When the ion exchange speed is slowed down, the detergency is liable to be lowered, and as the specific surface area is increased, the hygroscopic property and the $CO_2$ absorption property are increased, which in turn makes it likely to cause drastic quality deterioration. Incidentally, the average particle size referred herein is a median diameter obtained from a particle size distribution.

Next, the crystalline alkali metal silicates having the composition (2) above will detailed below.

These crystalline alkali metal silicates are represented by the general formula (2):

$$M_2O.x'SiO_2.y'H_2O, \quad (2)$$

wherein M stands for an alkali metal atom; x' is from 1.5 to 2.6; and y' is from 0 to 20. Among them, a preference is given to the crystalline alkali metal silicates having x' and y' in the general formula (2) such that each satisfies $1.7 \leqq x' \leqq 2.2$ and $y'=0$, and those having a cationic exchange capacity of preferably 100 $CaCO_3$ mg/g or more, more preferably from 200 to 400 $CaCO_3$ mg/g, are usable. The above crystalline alkali metal silicates are one of the materials having ion capturing ability in the present invention.

Since the crystalline alkali metal silicate in the present invention has not only good alkalizing ability and alkaline buffering capacity but also good ion exchange capacity, the washing conditions are suitably adjusted by adding suitable amounts of the crystalline alkali metal silicate.

A method for producing the above crystalline alkali metal silicates is disclosed in Japanese Patent Laid-Open No. 60-227895, of which the disclosure is incorporated herein by reference. However, the crystalline alkali metal silicates may be generally produced by baking glassy amorphous sodium silicate at a temperature of from 200 to 1000° C. to make it crystalline. Also, the crystalline alkali metal silicates are commercially available in powdery or granular forms under a trade name "Na-SKS-6" ($\delta$—$Na_2Si_2O_5$) (manufactured by Hoechst). Also, Japanese Patent Laid-Open No. 7-187655, of which the disclosure is incorporated herein by reference, discloses a crystalline alkali metal silicate containing particular amounts of potassium as well as sodium.

In the present invention, as in the case for the crystalline alkali metal silicates having the composition (1), the crystalline alkali metal silicates having the composition (2) have an average particle size of preferably from 0.1 to 100 μm, more preferably from 1 to 50 μm, still more preferably from 5 to 30 μm.

In the present invention, the crystalline alkali metal silicate having the compositions (1) and (2) may be used alone or in combination. It is preferred that the total amount of the crystalline alkali metal silicates is contained in an amount of 50 to 100% by weight, more preferably from 70 to 100% by weight, of the entire amount of the alkalizing agents in the detergent composition, wherein the alkalizing agents comprise crystalline alkali metal silicates usable in the present invention and other alkalizing agents, such as alkali metal carbonates. From the aspect of aggressively accelerating the self-emulsification effects of the sebum dirt stains, the amount of the crystalline alkali metal silicate is preferably 50% by weight or more.

In the present invention, amorphous alkali metal silicates, such as sodium silicates JIS No. 1, 2, and 3 may be used. The amorphous alkali metal silicates are likely to increase the degree of alkalinity rather than increasing an ion exchange capacity. Therefore, in order to have an even lower standard amount of dosage per cycle, the amorphous alkali metal silicate may be actually contained in an amount of preferably 12% by weight or less, more preferably from 1 to 10% by weight, a still more preferably from 2 to 7% by weight, of the entire detergent composition.

D) Metal Ion Capturing Agents Other Than Alkali Metal Silicates

The metal ion capturing agents other than the alkali metal silicates in the present invention preferably have a calcium ion capturing capacity of 200 $CaCO_3$ mg/g or more, more preferably 300 $CaCO_3$ mg/g or more. Examples of the polymers having the above metal ion capturing ability include polymers or copolymers, each having repeating units represented by the general formula (4):

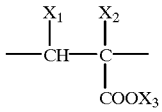

(4)

wherein $X_1$ stands for a methyl group, a hydrogen atom, or a $COOX_3$ group; $X_2$ stands for a methyl group, a hydrogen atom, or a hydroxyl group; $X_3$ stands for a hydrogen atom, an alkali metal ion, an alkaline earth metal ion, an ammonium ion, or 2-hydroxyethylammonium ion.

In the general formula (4), examples of the alkali metal ions include Na, K, and Li ions, and examples of the alkaline earth metal ions include Ca and Mg ions.

Examples of the polymers or copolymers usable in the present invention include those obtainable by polymerization reactions of acrylic acid, (anhydrous) maleic acid, methacrylic acid, α-hydroxyacrylic acid, crotonic acid, isocrotonic acid, and salts thereof; copolymerization reactions of each of the monomers; or copolymerization reactions of the above monomers with other copolymerizable monomers. Here, examples of the other polymerizable monomers used in copolymerization reaction include aconitic acid, itaconic acid, citraconic acid, fumaric acid, vinyl phosphonic acid, sulfonated maleic acid, diisobutylene, styrene, methyl vinyl ether, ethylene, propylene, isobutylene, pentene, butadiene, isoprene, vinyl acetate (vinyl alcohols in cases where hydrolysis takes place after copolymerization), and acrylic acid ester, without particularly being limited thereto.

Also, polyacetal carboxylic acid polymers such as polyglyoxylic acids disclosed in Japanese Patent Laid-Open No. 54-52196, of which the disclosure is incorporated herein by reference, are also usable for the polymers in the present invention.

In the present invention, the above polymers and copolymers preferably have a weight-average molecular weight of from 800 to 1,000,000, more preferably from 5,000 to 200,000.

Also, in the case of copolymers, although the copolymerization ratios between the repeating units of the general formula (4) and other copolymerizable monomers are not particularly limited, a preference is given to copolymerization ratios of the repeating units of general formula (4)/other copolymerizable monomer=1/100 to 90/10.

In the present invention, the above polymer or copolymer is contained in the entire composition in an amount of preferably from 1 to 50% by weight, more preferably from 2 to 30% by weight, particularly from 5 to 15% by weight.

In addition, a highly preferred example of D) the metal ion capturing agents comprise:

(D-i) the carboxylate polymer mentioned above having a Ca ion capturing capacity of 200 $CaCO_3$ mg/g or more; and (D-ii) an aluminosilicate having an ion exchange capacity of 200 $CaCO_3$ mg/g or more and having the following formula (3):

$$x''(M_2O).Al_2O_3.y''(SiO_2).w''(H_2O), \quad (3)$$

wherein M stands for an alkali metal atom, such as sodium atom or potassium atom; x", y", and w" each stands for a molar number of each component; and generally, x" is from 0.7 to 1.5; y" is from 0.8 to 6; and w" is from 0 to 20, wherein the weight ratio of (D-i) component to (D-ii) component is (D-i)/(D-ii)=1/20 to 4/1, preferably 1/9 to 4/1. The total amount of (D-i) and (D-ii) components preferably occupies 70 to 100% by weight of D) the metal ion capturing agents.

The aluminosilicates mentioned above may be crystalline or amorphous, and among the crystalline aluminosilicates, a particular preference is given to those having the following general formula:

$$Na_2O.Al_2O_3.ySiO_2.wH_2O,$$

wherein y is a number of from 1.8 to 3.0; and w is a number of from 1 to 6.

As for the crystalline aluminosilicates (zeolites), synthetic zeolites having an average, primary particle size of from 0.1 to 10 μm, which are typically exemplified by A-type zeolite, X-type zeolite, and P-type zeolite, are suitably used. The zeolites may be used in the forms of powder and/or a zeolite slurry, or dried particles comprising zeolite agglomerates obtained by drying the slurry.

On the other hand, the amorphous aluminosilicates represented by the same general formula as the above crystalline aluminosilicate may be produced by conventional methods.

The oil-absorbing amorphous aluminosilicate carrier having an ion exchange capacity of 100 $CaCO_3$ mg/g or more and an oil-absorbing capacity of 80 ml/100 g or more can be easily obtained. See Japanese Patent Laid-Open Nos. 62-191417 and 62-191419, of which each disclosure is incorporated herein by reference.

Beside the ones mentioned above, examples of the metal ion capturing agents constituting component D include aminotri(methylenephosphonic acid), 1-hydroxyethylidene-1,1-diphosphonic acid, ethylenediaminetetra (methylenephosphonic acid), diethylenetriaminepenta (methylenephosphonic acid), and salts thereof; salts of phosphonocarboxylic acids, such as salts of 2-phosphonobutane-1,2-dicarboxylic acid; amino acid salts, such as salts of aspartic acid and salts of glutamic acid; aminopolyacetates, such as nitrilotriacetates and ethylenediaminetetraacetates.

Components C and D are materials showing metal ion capturing abilities. Here, the methods for measuring the ion capturing capability of the metal ion capturing materials depend upon whether the metal ion capturing materials are the ion exchange materials or the chelating agents. The measurement methods for each of the materials are detailed below.

Ion Exchange Material

The amount 0.1 g of an ion exchange material is accurately weighed and added to 100 ml of a calcium chloride aqueous solution (500 ppm concentration, when calculated as $CaCO_3$), followed by stirring at 25° C. for 60 minutes. Thereafter, the mixture is filtered using a membrane filter (made of nitrocellulose; manufactured by Advantech) with 0.2 μm pore size. The amount 10 ml of the filtrate is assayed for Ca content by an EDTA titration, and the calcium ion exchange capacity (cationic exchange capacity) of the ion exchange material is calculated from the titer.

For instance, in the present invention, inorganic substances, including the crystalline alkali metal silicates and the aluminosilicates, such as zeolites, are measured as ion exchange materials.

Chelating Agent

The calcium ion capturing capacity of the chelating agent is measured by the following method using a calcium ion electrode. Incidentally, the solution used herein is prepared with the following buffer solution:

Buffer: 0.1 M—$NH_4Cl$—$NH_4OH$ buffer (pH 10.0)

(i) Preparation of Calibration Curve

Figure 1:
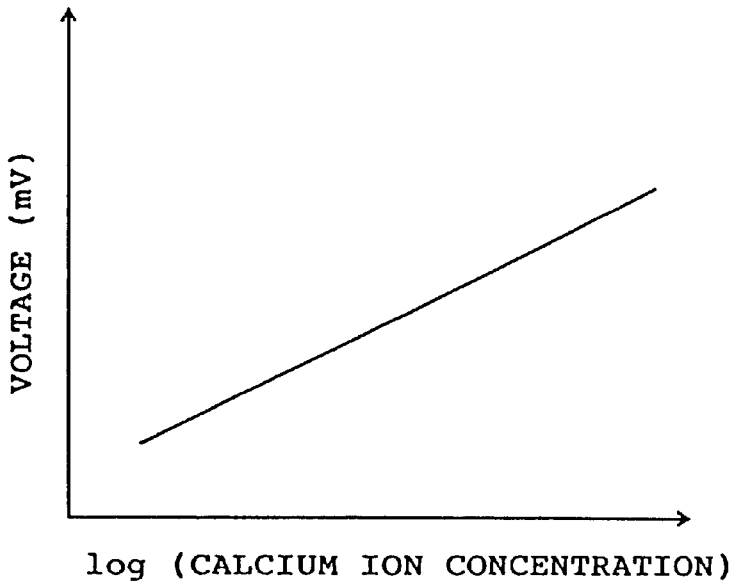
FIG. 1 is a graph of a calibration curve showing the relationship between the logarithm of the calcium ion concentration and the voltage.

A standard calcium ion solution is prepared and voltage readings are taken to prepare a calibration curve showing the relationships between the logarithm of the calcium ion concentration and the voltage, as shown in FIG. 1.

(ii) Measurement of Calcium Ion Capturing Capacity

About 0.1 g of a chelating agent is weighed, and a 100 ml volumetric flask is charged with the chelating agent. The volumetric flask is filled up to a volume of 100 ml with the above buffer solution. A $CaCl_2$ aqueous solution (pH 10.0) having a calcium ion concentration of 20,000 ppm calculated as $CaCO_3$ is added dropwise from a burette. The dropwise addition is made in an amount of 0.1 to 0.2 ml to obtain each voltage reading. Also, the buffer solution without containing the chelating agent is also subjected to the same dropwise treatment of the $CaCl_2$ aqueous solution. This solution is called a "blank solution." Thus, a calcium ion concentration is calculated from the calibration curve given in FIG. 1 by taking a voltage reading. The relationship between the amount of the $CaCl_2$aqueous solution added dropwise and the calcium ion concentration is shown in a graph (FIG. 2). In FIG. 2, Line P shows the data of the blank solution (buffer solution without using the chelating agent), and Line Q shows the data for the chelating agent-containing buffer solution. The point where the extension of the linear portion of Line Q intersects with the abscissa (horizontal axis) is called "A." The calcium ion capturing capacity of the chelating agent is obtained from the calcium ion concentration at "A" of the blank solution.

For instance, in the present invention, the polycarboxylates, such as citrates, and carboxylate polymers, such as acrylic acid-maleic acid copolymers are measured as chelating agents.

Examples of other ingredients which may be added to the detergent composition of the present invention as alkalizing agents include various compounds, including alkali metal salts of chlorides, carbonates, and sulfites, and organic amines, such as alkanolamines. In a case of providing a high-density detergent composition by processing spray-dried particles, it is preferred that sodium sulfate is blended as the backbone material in the detergent composition, and sodium sulfate is blended in an amount of preferably 8% by weight or less, more preferably from 0.5 to 6% by weight. Also, the amorphous sodium silicates mentioned above may be also blended as the backbone materials.

In addition, color-fading preventives and anti-redeposition agents generally blended in detergent compositions, including non-dissociating polymers such as polyethylene glycols, polyvinyl alcohols, and polyvinyl pyrrolidones; organic acid salt builders, such as diglycolates and hydroxycarboxylates; and carboxymethyl cellulose may be optionally used.

Besides the above, the following ingredients may be also contained in the detergent composition of the present invention. For instance, anti-caking agents such as lower alkylbenzenesulfonates of which alkyl moieties have about 1 to 4 carbon atoms, sulfosuccinates, talc, and calcium silicates; and antioxidants, such as tert-butylhydroxytoluene and distyrenated cresol, may be used together with stilbene-type and biphenyl-type fluorescent dyes as in conventional methods. Also, blueing agents may be added, and perfumes suitable for high-density detergents disclosed in Japanese Patent Laid-Open Nos. 63-101496 and 5-202387, of which each of the disclosures is incorporated herein by reference, may be also added. The kinds and use of these optional ingredients are not particularly limited thereto. Besides them, enzymes, such as proteases, lipases, cellulases, and amylases; bleaching agents, such as sodium percarbonate; bleaching activators, such as tetraacetyl ethylenediamine may be dry-blended as third separate granules in the detergent composition of the present invention. The optional ingredients are not particularly limited, and they may be blended so as to give desired compositions suitable for their purposes.

Also, other surfactants such as fatty acids derived from beef tallow, palm oil, or coconut oil, and/or an alkali metal salts of these fatty acids may be blended. When such surfactants are blended, they may be formulated in an amount of preferably 12% by weight or less, more preferably from 0.5 to 8% by weight in the detergent composition of the present invention. Besides them, cationic surfactants, including quaternary ammonium salts, such as alkyltrimethyl ammonium salts, and tertiary amines, and carboxy-type or sulfobetaine-type amphoteric surfactants, which are conventionally formulated in detergents, may be added in amounts so as not to impair the effects of the present invention.

In the detergent composition of the present invention, in order to reduce the amount of dosage per cycle, it is preferred that Component A, Component B, Component C, and Component D constitute from 50 to 99% by weight, more preferably from 70 to 99% by weight, particularly from 80 to 99% by weight, of the detergent composition of the present invention. As for other ingredients than Component A, Component B, Component C, and Component D, studies on the formulation of the enzymes, fluorescent dyes, perfumes, and in some cases bleaching agents and bleaching activators, each of which is listed above have been made.

The powder detergent compositions of the present invention may contain each of the components described above. These granules may be produced without particular limitation by referring to the conventionally known methods. Examples of the methods for producing high-density detergents include the methods disclosed in Japanese Patent Laid-Open Nos. 61-69897, 61-69899, 61-69900, 5-209200, and DE19529298, of which each of the disclosures is incorporated herein by reference. In addition, a method for obtaining a detergent composition with an even higher density may be referred to WO95/26394, of which the disclosure is incorporated herein by reference.

The present invention will be more specifically explained of the following preparation examples and test examples, without intending to restrict the scope of the present invention thereto.

The physical properties of products obtained in the preparation examples, etc. measured by the following methods.

(1) Amount of Materials Having Ion Capturing Capacity

The ion capturing ability is measured by the following different methods in accordance with a case where the materials used having a metal ion capturing capacity are ion exchange materials and a case where the materials are chelating agents.

The metal ion capturing capacity and the calcium ion capturing capacity are measured by the method described above.

Incidentally, the ion capturing capacity of the metal ion capturing agents is expressed in Table 1 as CEC (calcium ion exchange capacity) as in the same manner as that of the alkali metal silicates. In addition, the DH water hardness is measured by ion coupling plasma method (ICP method).

(2) Average Particle Size and Particle Size Distribution of Alkali Metal Silicates The average particle size and the particle size distribution are measured by using a laser scattering particle size distribution analyzer. Specifically, about 200 ml of ethanol is poured into a measurement cell of a laser scattering particle size distribution analyzer ("LA-700," manufactured by HORIBA Ltd.), and about 0.5 to 5 mg of the sample is suspended in ethanol. Next, while subjecting the obtained ethanol suspension to ultrasonic wave irradiation, the mixture is agitated for one minute, to thereby sufficiently disperse the sample. Thereafter, the resulting mixture is subjected to an He—Ne laser beam (632.8 nm) irradiation to measure diffraction/scattering patterns. The particle size distribution is obtained from the diffraction/scattering patterns. The analysis is made based on the combined theories of Fraunhofer diffraction theory and Mie scattering theory. The particle size distribution of the suspended particles in the liquid is measured within the size range of from 0.04 to 262 μm. The average particle size is a median diameter of the particle size distribution.

PREPARATION EXAMPLE 1 (Crystalline Alkali Metal Silicate A)

To 1000 parts by weight of No. 2 sodium silicate ($SiO_2$/$Na_2O$=2.5), 55.9 parts by weight of sodium hydroxide and 8.5 parts by weight of potassium hydroxide were added, and the components were stirred using a homomixer to thereby dissolve sodium hydroxide and potassium hydroxide. To the above mixture, 5.23 parts by weight of finely dispersed anhydrous calcium carbonate and 0.13 parts by weight of magnesium nitrate hexahydrate were added and agitated using a homomixer. A given amount of the mixture was transferred into a nickel crucible and baked in the air at a temperature of 700° C. for one hour, and then the baked product was rapidly cooled. The resulting baked product was pulverized, to give Crystalline Alkali Metal Silicate A in the present invention. This powder had a high ion exchange capacity (CEC) of 305 $CaCO_3$ mg/g. Here, the average particle size of the resulting Crystalline Alkali Metal Silicate A was 22 μm.

TABLE 1

| $M_2O$ | K/Na | y/x | $Me_mO_n$ | z/x | Mg/Ca | CEC $CaCO_3$ mg/g |
|---|---|---|---|---|---|---|
| Crystalline Alkali Metal Silicate A $Na_2O$, $K_2O$ | 0.03 | 1.8 | CaO, MgO | 0.02 | 0.01 | 305 |
| $Na_2O$ (SKS-6) | — | 2.0 | — | — | — | 245 |

PREPARATION EXAMPLE 2 (Amorphous Aluminosilicate)

Sodium carbonate was dissolved in ion-exchanged water, so as to prepare an aqueous solution with 6% by weight concentration. 132 g of the above aqueous solution and 38.28 g of a sodium aluminate aqueous solution (conc. 50% by weight) were placed in a 1000-ml reaction vessel equipped with baffles. 201.4 g of a solution of No. 3 liquid glass diluted with twice the amount of water were added dropwise to the above mixed solution by under vigorous agitation at a temperature of 40° C. over a period of 20 minutes. Here, the reaction speed was optimized by blowing a $CO_2$ gas thereinto to thereby adjust the pH of the reaction system to 10.5. Thereafter, the reaction system was heated up to a temperature of 50° C. and stirred at 50° C. for 30 minutes. Subsequently, an excess alkali was neutralized by blowing a $CO_2$ gas thereinto, to thereby adjust the pH of the reaction system to 9.0. The obtained neutralized slurry was filtered under a reduced pressure using a filter paper (No. 5C, manufactured by Toyo Roshi Kaisha, Ltd.). The filtered cake was rinsed with water in an amount of 1000-folds that of the cake, and the rinsed cake was filtered and dried under the conditions of 105° C., 300 Torr, and 10 hours. Further, the dried cake was disintegrated, to give an amorphous aluminosilicate powder in the present invention. Incidentally, the sodium aluminate aqueous solution was prepared by the steps of adding and mixing 243 g of $Al(OH)_3$ and 298.7 g of a 48% by weight NaOH aqueous solution in a 1000 cc four-necked flask, heating the mixture to a temperature of 110° C. with stirring, and maintaining at the same temperature for 30 minutes, to dissolve the components.

From the results of atomic absorption spectrophotometry and plasma emission spectrochemical analysis, the resulting amorphous aluminosilicate had the following composition: $A_2O_3$=29.6% by weight; $SiO_2$=52.4% by weight; and $Na_2O$=18.0% by weight (1.0 $Na_2O.Al_2O_3$.3.10 $SiO_2$). In addition, the cationic exchange capacity (CEC) was 185 $CaCO_3$ mg/g, and the oil-absorbing capacity was 285 ml/100 g. The content of the microporous capacity having a microporous diameter of less than 0.1 μm w as 9.4% by volume in the entire micropores, and the content of the microporous capacity having a microporous diameter of 0.1 μm or more and 2.0 μm or less was 76.3% by volume in the entire micropores. The water content was 11.2% by weight.

PREPARATION EXAMPLE 3 (Detergent Compositions)

Detergent Composition 1 was prepared as follows:

From the ingredients listed in Table 2, ingredients, excluding, on a weight basis in the entire detergent composition, 3% by weight of a nonionic surfactant, 15% by weight of a crystalline alkali metal silicate (i.e., "SKS-6" (manufactured by Hoechst) for Detergent Composition 1), 10% by weight of ZEOLITE, and 1.2% by weight of enzymes, were used to prepare an aqueous slurry of 50% by weight solid content. The slurry was spray-dried to give spray-dried granules. Subsequently, the obtained spray-dried granules were supplied into High-Speed Mixer (manufactured by Fukae Powtec Corp.) together with 10% by weight of the crystalline alkali metal silicate in the entire detergent composition. The above components were subjected to agitation granulation by pulverization while spraying the remaining 3% by weight of the nonionic surfactant. After completing granulation, 5% by weight of ZEOLITE in the entire detergent composition was supplied in the mixer, and the mixture was agitated to coat the surfaces of the granules. The surface-coated granules were transferred to a V-type blender and mixed with the remaining ZEOLITE, the remaining crystalline alkali metal silicate, and 1.2% by weight of enzymes to give a high-density detergent of Detergent Composition 1.

Detergent Composition 4 was prepared in basically the same manner as Detergent Composition 1 except that ZEOLITE was added in place of the crystalline alkali metal silicate.

Detergent Composition 5 was prepared in the same manner as Detergent Composition 1 except that no crystalline alkali metal silicates were added in the slurry. Instead, the crystalline alkali metal silicate was added, on a weight basis in the entire detergent composition, in an amount of 10% by weight together with 1% by weight of ZEOLITE during granulation. The remaining crystalline alkali metal silicate was added during mixing in the V-type blender.

Detergent Compositions 2 and 3 were prepared by the following procedures.

Detergent Composition 2

An aqueous slurry of 50% by weight solid content was prepared, the slurry comprising, on a weight basis in the entire detergent composition, 12% by weight of SFE-Na, 4% by weight of the nonionic surfactant, 19% by weight of ZEOLITE, 5% by weight of the acrylic acid-maleic acid copolymer, 8% by weight of the sodium salt of a fatty acid, 8% by weight of sodium sulfate, 1% by weight of sodium sulfite, and 0.3% by weight of the fluorescent dye. The slurry was spray-dried to give spray-dried granules. The obtained spray-dried granules, 10% by weight of the crystalline alkali metal silicate and 4.8% by weight of sodium carbonate, the crystalline alkali metal silicate and sodium carbonate being added on a weight basis in the entire detergent composition, were supplied in a ribbon mixer, and the components were blended while spraying the remaining nonionic surfactant. The resulting mixture was subjected to an extrusion granulation using a twin-screw type front extrusion granulator ("PELLETER DOUBLE," manufactured by Fuji Paudal Co., Ltd.) and made compact by forming cylindrical pellets with a diameter of 10 mm. The resulting pellets, together with 5% by weight of ZEOLITE in the entire detergent composition were pulverized and granulated using a flush mill (manufactured by Fuji Paudal Co., Ltd.) to carry out surface coating of the resulting granules. After coarse-grained products were removed, the resulting granules were transferred to a V-type blender and mixed with the remaining crystalline alkali metal silicate, the remaining ZEOLITE and 1.2% by weight of the enzymes, to give a high-density detergent of Detergent Composition 2.

Detergent Composition 3

An aqueous slurry of 50% by weight solid content was prepared, the slurry comprising, on a weight basis in the entire detergent composition, 20% by weight of LAS-Na, 10% by weight of SFE-Na, 3% by weight of AS-Na, 15% by weight of ZEOLITE, 5% by weight of the acrylic acid-maleic acid copolymer, 2% by weight of the sodium salt of a fatty acid, 5% by weight of sodium sulfate, 1% by weight of sodium sulfite, and 0.3% by weight of the fluorescent dye. The slurry was spray-dried to give spray-dried granules. The obtained spray-dried granules and 10% by weight of Crystalline Alkali Metal Silicate A in the entire detergent composition were supplied in a ribbon mixer, and the components were blended. The resulting mixture was subjected to an extrusion granulation using a twin-screw type front extrusion granulator ("PELLETER DOUBLE" manufactured by Fuji Paudal Co., Ltd.) and made compact by forming a cylindrical pellet with a diameter of 10 mm. The resulting pellets, together with 5% by weight of ZEOLITE in the entire detergent composition, were pulverized and granulated using a flush mill (manufactured by Fuji Paudal Co., Ltd.) to carry out surface coating of the resulting granules. After coarse-grained products were removed, the resulting granules were transferred to a V-type blender and mixed with the remaining crystalline alkali metal silicates, comprising the remaining Crystalline Alkali Metal Silicate A and 5% by weight of SKS-6, the remaining ZEOLITE, and 1.2% by weight of the enzymes, to give a high-density detergent of Detergent Composition 3.

The bulk densities of Detergent Compositions 1 to 5 were in the range of from 0.76 to 0.80 g/cc, and the average particle size was from 300 to 600 $\mu$m.

TABLE 2

| Composition (% by weight) | Detergent Comp. 1 | Detergent Comp. 2 | Detergent Comp. 3 |
|---|---|---|---|
| A) Component | | | |
| LAS-Na (C12–14) | 22 | — | 20 |
| SFE-Na (Palm Oil-Derived) | — | 12 | 10 |
| B) Component | | | |
| AS-Na (C12–16) | 3 | — | 3 |
| Polyoxyethylene alkyl ether (nC12POE = 5.8) | 6 | 10 | — |
| C) Component | | | |
| Crystalline Alkali Metal Silicate A (S/N = 1.8) | — | — | 20 |
| SKS-6 (manufactured by Hoechst) (S/N = 2.0) | 15 | 18 | 5 |

TABLE 2-continued

| Composition (% by weight) | | Detergent Comp. 1 | Detergent Comp. 2 | Detergent Comp. 3 |
|---|---|---|---|---|
| D) Component | | | | |
| Zeolite 4A | | 25 | 29 | 25 |
| Acrylic Acid-Maleic Acid Copolymer (MW = 70000) | | 5 | 5 | 5 |
| Other Components | | | | |
| Sodium Salt of Fatty Acid (Beef Tallow-Derived) | | 3 | 8 | 2 |
| JIS No. 1 Sodium Silicate | | 8 | — | — |
| Sodium Carbonate | | 5 | 4.8 | — |
| Sodium Sulfate | | 2 | 8 | 5 |
| Sodium Sulfite | | 1 | 1 | 1 |
| Fluorescent Dye | | 0.3 | 0.3 | 0.3 |
| Protease | | 0.6 | 0.6 | 0.6 |
| Cellulase | | 0.5 | 0.5 | 0.5 |
| Lipase | | 0.1 | 0.1 | 0.1 |
| Water Content | | 3.5 | 2.7 | 2.5 |
| Detergency (%) | Detergent Conc. | | | |
| | 0.83 g/L | 64.9 | 64.0 | 67.1 |
| | 0.67 g/L | 60.9 | 61.9 | 64.5 |
| | 0.50 g/L | 58.1 | 60.0 | 62.1 |
| Bulk Density (g/cc) | | 0.76 | 0.79 | 0.80 |

TABLE 3

| Composition (% by weight) | | Detergent Comp. 4* | Detergent Comp. 5* |
|---|---|---|---|
| A) Component | | | |
| LAS-Na (C12–14) | | 22 | 35 |
| SFE-Na (Palm Oil-Derived) | | — | — |
| B) Component | | | |
| AS-Na (C12–16) | | 3 | 3 |
| Polyoxyethylene alkyl ether (nC12POE = 5.8) | | 6 | 6 |
| C) Component | | | |
| Crystalline Alkali Metal Silicate A (S/N = 1.8) | | — | — |
| SKS-6 (manufactured by Hoechst) (S/N = 2.0) | | — | 32 |
| D) Component | | | |
| Zeolite 4A | | 40 | 1 |
| Acrylic Acid-Maleic Acid Copolymer (MW = 70000) | | 5 | 3 |
| Other Components | | | |
| Sodium Salt of Fatty Acid (Beef Tallow-Derived) | | 3 | — |
| JIS No. 1 Sodium Silicate | | 8 | 8 |
| Sodium Carbonate | | 5 | 5 |
| Sodium Sulfate | | 2 | 2 |
| Sodium Sulfite | | 1 | 1 |
| Fluorescent Dye | | 0.3 | 0.3 |
| Protease | | 0.6 | 0.6 |
| Cellulase | | 0.5 | 0.5 |
| Lipase | | 0.1 | 0.1 |
| Water Content | | 3.5 | 2.5 |
| Detergency (%) | Detergent Conc. | | |
| | 0.83 g/L | 54.2 | 67.1 |
| | 0.67 g/L | 49.6 | 57.6 |
| | 0.50 g/L | 46.3 | 41.9 |
| Bulk Density (g/cc) | | 0.76 | 0.79 |

TEST EXAMPLE 1

Detergent Compositions obtained in Preparation Examples mentioned above were used to carry out a detergency test under the following conditions:

Preparation of Artificially Stained Cloth

A sheet of cloth was stained with an artificial staining liquid having the following compositions. The artificially stained cloth was produced by printing the artificial staining liquid on the sheet of cloth by an engravure staining machine equipped with an engravure roll coater. The process for staining the cloth with the artificial staining liquid to prepare an artificially stained cloth was carried out under the conditions of a cell capacity of a gravure roll of 58 $cm^3/cm^2$, a coating speed of 1.0 m/min, a drying temperature of 100° C., and a drying period of time of one minute. As to sheet of cloth, #2003 calico, manufactured by Tanigashira Shoten was used. The preparation of artificially stained cloth using gravure roll coater are detailed in Japanese Patent Laid-Open No. 7-270395, of which the disclosure is incorporated herein by reference.

| | |
|---|---|
| Myristic acid | 1.8% by weight |
| Palmitic acid | 3.5% by weight |
| Oleic acid | 9.6% by weight |
| Linoleic acid | 1.1% by weight |
| Triolein | 12.5% by weight |
| Squalene | 6.0% by weight |
| Egg white lecithin crystalline liquid | 2.0% by weight |
| Kanuma sekigyoku soil | 7.98% by weight |
| Carbon black | 0.02% by weight |
| Tap water | Balance |

Washing Conditions

Washing of the above-mentioned artificially stained cloth with 3.5°DH water is carried out by using turgometer at a rotational speed of 100 rpm, at a temperature of 20° C. for 10 minutes, and washing was carried out with a detergent composition listed in Tables 2 and 3. Here, the typical water hardness-increasing components (namely minerals) in the water for washing are $Ca^{2+}$ and $Mg^{2+}$. The ratio of $Ca^{2+}$ to $Mg^{2+}$ is generally within the range of Ca/Mg=60/40 to 85/15. In the present test, tap water is used. The unit "°DH" refers to a water hardness which was calculated by replacing Mg ions with equimolar amounts of Ca ions.

Calculation of Detergency

Reflectivities of the original cloth and those of the stained cloth before and after washing were measured at a wavelength of 550 nm by means of an automatic recording colorimeter (manufactured by Shimadzu Corporation). The detergency D (%) was calculated by the following equation. The results thereof are also shown in Tables 2 and 3.

$$D = \frac{(L_2 - L_1)}{(L_0 - L_1)} \times 100(\%),$$

wherein $L_0$: Reflectivity of the original cloth;

$L_1$: Reflectivity of the stained cloth before washing; and $L_2$: Reflectivity of the stained cloth after washing.

Incidentally, the abbreviations and materials shown in the tables are as follows:

LAS-Na: Sodium linear alkylbenzenesulfonate.

SFE-Na: Sodium salt of α-sulfofatty acid methyl ester.

AS-Na: Sodium alkyl sulfate.

POE: Ethylene oxide moiety with molar number.

ZEOLITE 4A: Average particle size of 3 μm, CEC=280 $CaCO_3$ mg/g.

Acrylic acid-maleic acid copolymer: "SOKALAN CP5," (manufactured by BASF Aktiengesellschaft), a copolymer made of acrylic acid monomers and maleic acid monomers, weight-average molecular weight of 70,000, CEC=380 $CaCO_3$ mg/g.

Fluorescent dye: "CINOPEARL CBS-X" (distyryl biphenyl derivative, manufactured by Ciba Geigy AG).

SKS-6: Manufactured by Hoechst, CEC=245 $CaCO_3$ mg/g.

Enzymes: Except for Lipase, amount being expressed by amount of protein. Protease: ALKALI PROTEASE K-16 disclosed in Japanese Patent Laid-Open No. 5-25492, of which the disclosure of which is incorporated herein by reference. Cellulase: ALKALI CELLULASE K disclosed in Japanese Patent Laid-Open No. 63-264699, of which the disclosure of which is incorporated herein by reference.

Lipase: LIPOLASE, manufactured by NOVO Nordisk Bioindustry LTD.

As is clear from the above results, even in cases where washing is carried out at a lower standard amount of dosage per cycle, Detergent Compositions 1 to 3 having compositions satisfying the detergent compositions of the present invention show a superior detergency to Detergent Composition 4 which comprises a conventional composition or to Detergent Composition 5 where the blending ratio of the crystalline alkali metal silicate is increased instead of using a ZEOLITE and polymer.

In addition, the detergency performance for cases where the water hardness is harder than the water used is evaluated by carrying out a detergency test using Detergent Composition 1. In a case where the water used is 8°DH, excellent detergency can be obtained when a detergent concentration is 1.20 g/L under the condition of a washing temperature of 30° C. Also, in a case where the water used is 15°DH, excellent detergency can be obtained when a detergent concentration is 2.50 g/L under the conditions of a washing time of 30 minutes and a washing temperature of 40° C. Incidentally, other washing conditions are the same as above.

INDUSTRIAL APPLICABILITY

According to the detergent composition for washing clothes of the present invention, the standard amount of dosage of the detergent composition is remarkably reduced when compared to the conventional compact-type detergent compositions for clothes washing. In addition, since the detergent composition is phosphorus-free, the detergent composition is less likely to cause environmental problems.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A detergent composition for clothes washing comprising:

(I) surfactant components comprising:

A) one or more sulfonate-type anionic surfactants; and

B) at least one secondary surfactant selected from the group consisting of nonionic surfactants and sulfate-type anionic surfactants, wherein a weight ratio of Component B to Component A is B/A=1/10 to 2/1; and (II) components comprising:

C) one or more alkali metal silicates which are metal ion capturing agents and/or alkalizing agents; and D) one or more metal ion capturing agents other than component C), wherein a weight ratio of Component C to Component D is C/D=1/15 to 5/1, wherein a total amount of the components (I) is from 20 to 50% by weight, and a total amount of the components (II) is from 30 to 80% by weight, and wherein the detergent composition has a bulk density of 0.6 g/cc or more.

2. The detergent composition for clothes washing according to claim 1, wherein said crystalline alkali metal silicate is contained in an amount of from 50 to 100% by weight of the entire amount of alkalizing agents in the detergent composition.

3. The detergent composition for clothes washing according to claim 1, wherein said crystalline alkali metal silicate has an $SiO_2/M_2O$ molar ratio of from 0.5 to 2.6, wherein M stands for an alkali metal.

4. The detergent composition according to claim 3, wherein the crystalline alkali metal silicate is represented by the following formula (1):

$$xM_2O.ySiO_2.zMe_mO_n.wH_2O, \quad (1)$$

wherein M stands for an element in Group Ia of the Periodic Table; Me stands for one or more members selected from the group consisting of elements in Group IIa, IIb, IIIa, IVa, and VIII; y/x is 0.5 to 2.6; z/x is 0.01 to 1.0; n/m is 0.5 to 2.0; and w is 0 to 20.

5. The detergent composition according to claim 3, wherein the crystalline alkali metal silicate is represented by the following formula (2):

$$M_2O.x'SiO_2.y'H_2O, \quad (2)$$

wherein M stands for an alkali metal atom; x' is 1.5 to 2.6; and y' is 0 to 20.

6. The detergent composition according to claim 1, wherein the D) metal ion capturing agents comprise:

(D-i) a carboxylate polymer having a Ca ion capturing capacity of 200 $CaCO_3$ mg/g or more; and (D-ii) an aluminosilicate having an ion exchange capacity of 200 $CaCO_3$ mg/g or more and having the following formula (3):

$$x''(M_2O).Al_2O_3.y''(SiO_2).w''(H_2O), \quad (3)$$

wherein M stands for an alkali metal atom; x", y", and w" each stands for a molar number of each component; x" is from 0.7 to 1.5; y" is from 0.8 to 6; and w" is from 0 to 20, and wherein a weight ratio of (D-i) component to (D-ii) component is (D-i)/(D-ii)=1/20 to 4/1, and a total amount of (D-i) and (D-ii) components occupies 70 to 100% by weight of the D) metal ion capturing agent.

7. In a process for washing clothes utilizing a detergent composition, the improvement for which comprises using a composition as claimed in claim 1 as a detergent composition.

8. The process according to claim 7, wherein the detergent composition is used at a concentration of from 0.33 to 0.67 g/L in the washing liquid with a water hardness of from 2 to 6°DH.

9. The process according to claim 7, wherein the detergent composition is used at a concentration of from 0.50 to 1.20 g/L in the washing liquid with a water hardness of from 6 to 10°DH.

10. The process according to claim 7, wherein the detergent composition is used at a concentration of from 0.80 to 2.50 g/L in the washing liquid with a water hardness of from 10 to 20°DH.

11. The detergent composition for clothes washing according to claim 1, wherein the sulfonate-type anionic surfactants are one or more compounds selected from the group consisting of linear alkylbenzenesulfonates, wherein the alkyl moiety has an average number of carbon atoms of 12 to 18; -sulfofatty acid salts or methyl ester salts thereof, wherein the alkyl moiety has an average number of carbon atoms of 14 to 18; and -olefinsulfonates wherein the alkyl moiety has an average number of carbon atoms of 12 to 18.

12. The detergent composition for clothes washing according to claim 1, wherein said nonionic surfactants are one or more polyoxyalkylene alkyl ethers.

13. The detergent composition for clothes washing according to claim 12, wherein said polyoxyalkylene alkyl ethers are alkylene oxide adducts of alcohols obtained by adding an alkylene oxide in an average amount of 4 to 10 moles of alcohol, wherein the alkyl moiety has an average number of carbon atoms of 10 to 18.

14. The detergent composition for clothes washing according to claim 1, wherein said sulfate-type anionic surfactants are one or more compounds selected from the group consisting of alkylsulfates, wherein the alkyl moiety has an average number of carbon atoms of 12 to 22; alkenylsulfates, wherein the alkenyl moiety has an average number of carbon atoms of 12 to 22; and alkyl ether sulfates, wherein the ethylene oxide moiety has an average addition molar number of 1 to 4.

15. The detergent composition for clothes washing according to claim 1, wherein said alkali metal silicate is a crystalline alkali metal silicate.

* * * * *